United States Patent [19]

Ohno

[11] 4,099,484

[45] Jul. 11, 1978

[54] PRESSURE FIXING APPARATUS FOR ELECTROPHOTOGRAPHY

[75] Inventor: Yukihiro Ohno, Tokyo, Japan

[73] Assignee: Ricoh Co., Ltd., Tokyo, Japan

[21] Appl. No.: 693,442

[22] Filed: Jun. 7, 1976

[30] Foreign Application Priority Data

Jun. 10, 1975 [JP] Japan ..... 50-69179

[51] Int. Cl.[2] ..... B05C 11/02

[52] U.S. Cl. ..... 118/117; 226/199; 271/240; 100/168

[58] Field of Search ..... 118/114–117, 118/227; 100/168, 169, 171, 47; 271/240; 226/199; 19/238

[56] References Cited

U.S. PATENT DOCUMENTS

| | | | |
|---|---|---|---|
| 2,100,653 | 11/1937 | Umansky | 100/47 UX |
| 2,738,554 | 3/1956 | Whitehurst | 19/238 |
| 2,840,374 | 6/1958 | Roseman | 271/240 |
| 3,006,225 | 10/1961 | Mamas | 100/47 X |

*Primary Examiner*—Dorsey Newton
*Attorney, Agent, or Firm*—Frank J. Jordan

[57] ABSTRACT

A handle or knob is connected to laterally position parallel sheet edge guides so that the distance between the guides is equal to the width of a sheet to which a toner image is to be fixed by pressure rollers. The handle or knob is also connected to an adjustable spring assembly which presses the rollers together in such a manner that the spring force acting on the rollers is a function of the sheet width.

15 Claims, 5 Drawing Figures

PRESSURE FIXING APPARATUS FOR ELECTROPHOTOGRAPHY

BACKGROUND OF THE INVENTION

The present invention relates to a pressure fixing apparatus for electrophotography in which the pressing force applied by pressure rollers to fix a toner image to a sheet is a function of the width of the sheet.

It is well known in the art to fix a toner image to a copy sheet by feeding the sheet between pressure rollers which crush the toner particles into the sheet. The pressing force of the rollers is usually set to be sufficient for the widest sheet which the electrophotographic copying machine in which the fixing apparatus is provided can accomodate. A problem arises in that this force is too great for sheets of smaller width, resulting in crushing of the photoconductive layer on the sheets which changes the luster. For very narrow sheets, the force may be so great that the sheets will be wrinkled. Such wrinkles not only render the copy unusable but cause stress concentrations on the rollers. Such wrinkles may also cause a sheet jam necessitating partial disassembly of the apparatus to remove the jammed sheet or sheets.

SUMMARY OF THE INVENTION

It is an object of the present invention to provide a pressure fixing apparatus for electrophotography in which the pressing force applied to a copy sheet to fix a toner image thereto is varied in accordance with the width of the sheet.

It is another object of the present invention to provide a pressure fixing apparatus which provides copies of good luster.

It is another object of the present invention to provide a pressure fixing apparatus which eliminates wrinkles on copy sheets.

It is another object of the present invention to provide a pressure fixing apparatus which minimizes the possibility of sheet jams.

It is another object of the present invention to provide a pressure fixing apparatus comprising means for reducing the pressing force to substantially zero to remove jammed sheets.

Other objects, together with the foregoing, are attained in the embodiments described in the following description and illustrated in the accompanying drawings.

DESCRIPTION OF THE PREFERRED EMBODIMENTS

Figure 1:
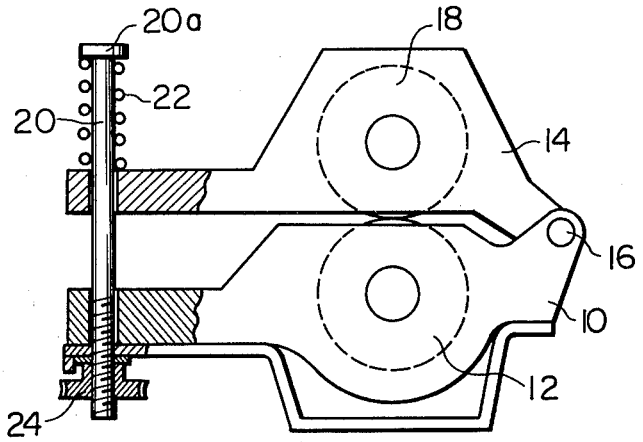
FIG. 1 is a side elevation of a pressure fixing roller assembly of the present invention.

While the pressure fixing apparatus of the invention is susceptible of numerous physical embodiments, depending upon the environment and requirements of use, substantial numbers of the herein shown and described embodiments have made, tested and used and all have performed in an eminently satisfactory manner. Throughout the various figures of the drawing like elements are designated by the same reference numerals.

Figure 2:
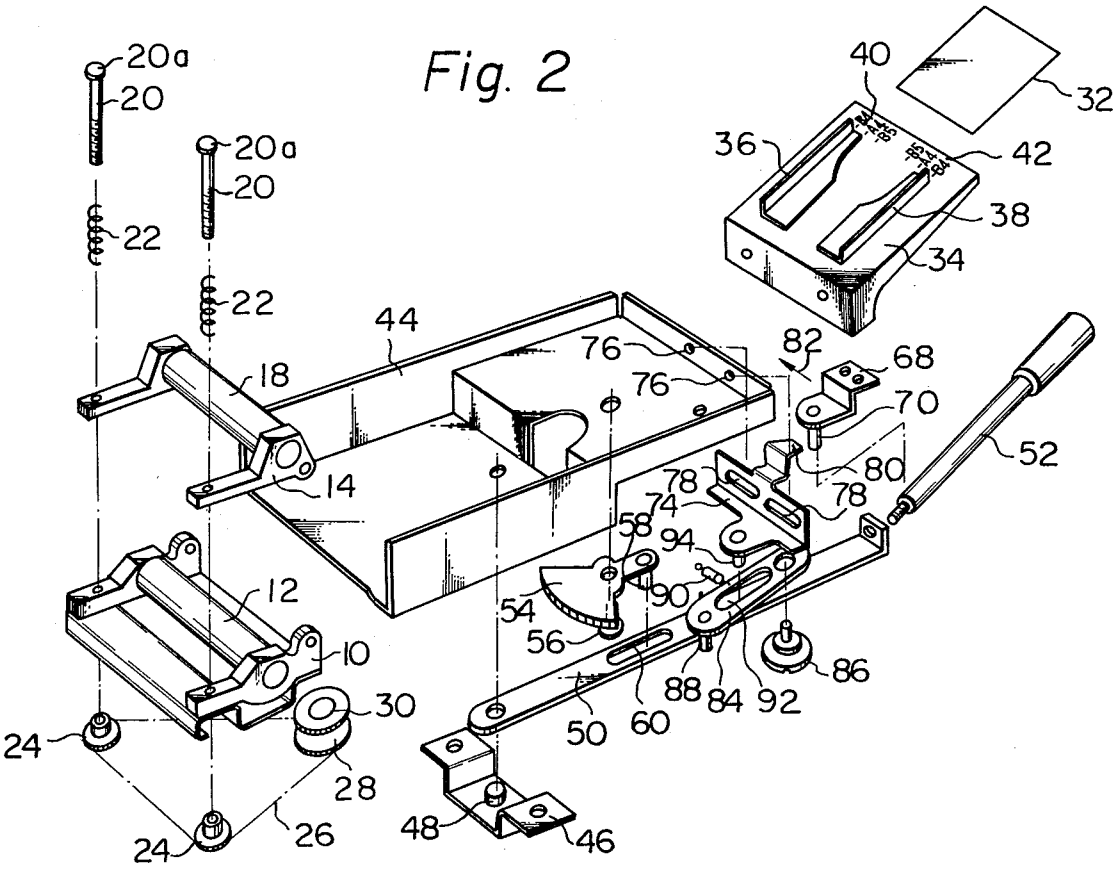
FIG. 2 is an exploded perspective view of a first embodiment of a pressure fixing apparatus of the present invention.

Referring now to FIGS. 1 and 2, a pressure fixing roller assembly comprises a fixed roller mounting 10 which rotatably supports a pressure fixing roller 12 and a movable roller mounting 14 which rotatably supports a pressure fixing roller 18 and is hinged to the fixed mounting 10 by a shaft 16. Bolts 20 slidingly extend through holes (no numerals) in the mountings 10 and 14, and compression springs 22 are coaxially retained around the bolts 20 and engage at their opposite ends with heads **20*a* of the bolts 20 and the upper surface of the movable mounting 14. Sprockets 24 are threaded onto the bolts 20 and engage with the lower surface of the fixed mounting 10**.

Conventional means such as a key and keyway which are not shown prevent the bolts 20 from rotating. As the sprockets 24 are screwed further onto the bolts 20, the springs 22 are compressed between the heads **20*a* of the bolts 20 and the movable mounting 14 so as to urge the movable mounting 14 toward the fixed mounting 10 and press the rollers 12 and 18 together. The pressing force between the rollers 12 and 18 can be easily varied by adjustably rotating the sprockets 24. As best seen in FIG. 2, a chain 26 is trained around the sprockets 24 and a sprocket 28 integral with a gear 30 so that the sprockets 24 may be rotated together by rotating the gear 30**.

The electrophotographic copying machine incorporating the present pressure fixing apparatus is typically of the type in which a copy sheet 32 is formed with a photoconductive layer and placed on a sheet feed tray 34 provided with entry means in the form of sheet edge guides 36 and 38 which engage with the opposite edges of the sheet 32. It is to be noted that the copy sheet 32 may be in the form of both a stack of sheets and a roll sheet. The tray 34 is provided with calibrations 40 and 42 corresponding to the positions of the edge guides 36 and 38 respectively for different sheet sizes and is fixedly mounted to one end of a main body 44 of the electrophotographic copying machine. The fixed mounting 10 of the pressure fixing apparatus is mounted to the opposite end of the main body 44.

Although the various components of the copying machine are not shown since they are not the subject matter of the present invention, a charging unit which applies an electrostatic charge to the photoconductive layer of the sheet 32, an imaging unit which radiates a light image of an original document onto the sheet 32 to produce an electrostatic image thereon and a developing unit which applies a toner substance to the sheet 32 to produce a visible toner image thereon are operatively mounted to the main body 44 between the feed tray 34 and the pressure fixing rollers 12 and 18. The pressure fixing rollers 12 and 18 serve to crush the toner substance into the sheet 32 to fix the toner image thereto. Either of the rollers 12 and 18 is driven by a motor (not shown) so that the roller 12 rotates counterclockwise and the roller 18 rotates clockwise. The sheet 32 is fed between the rollers 12 and 18 for pressure fixing.

As shown in FIG. 2 a bracket 46 is mounted to the bottom of the main body 44 and has a pin 48 fixed thereto which serves as a pivot for an actuating member or arm 50 provided with a detachable handle 52. A gear sector 54 is rotatably mounted to the main body 44 by means of a pin 56 and has a pin 58 extending downwardly therefrom. The pin 58 is slidably received in a longitudinal slot 60 formed in the arm 50. The gear sector 54 meshes with the gear 30.

Figure 3:
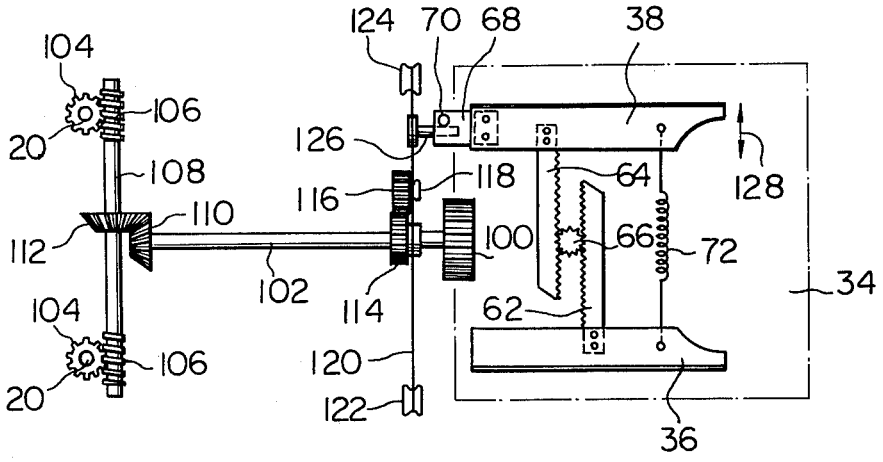
FIG. 3 is a schematic view from below of a second embodiment of the present invention.

Although FIG. 3 illustrates a second embodiment of the invention, the feed tray 34 is the same as that in the embodiment of FIG. 2. In FIG. 3, in which the tray 34 is viewed from the bottom, it will be seen that the previously referred to entry means further comprises racks 62 and 64 fixed to the edge guides 36 and 38 respectively and extend perpendicularly therefrom. Both of the racks 62 and 64 mesh with a pinion 66 in such a manner that lateral movement of the edge guide 38 causes symmetrical movement of the edge guide 36. A bracket 68 is fixed to the bottom of the edge guide 38 and has a pin 70 fixed thereto which extends downwardly. A tension spring 72 is connected at its opposite ends to the edge guides 36 and 38 to urge them together.

Referring again to FIG. 2, a sliding link 74 is slidingly mounted to the same side of the main body 44 as the tray 34 by means of pins 76 extending from the body 44 which engage in lateral slots 78 formed in the sliding link 74. A tab 80 extends from the link 74. Since the edge guide 38 and bracket 68 are urged in the direction of an arrow 82 by the spring 72, the pin 70 is urged into abutment with the tab 80.

A pivotal link 84 is pivotally mounted to the main body 44 by a pin 86. A pin 88 extends downwardly from the link 84. A tension spring 90 urges the link 84 so that the pin 88 is maintained in engagement with the edge of the arm 50 as shown. The link 84 is formed with a longitudinal slot 92 in which a pin 94 extending downwardly from the sliding link 74 engages.

The operation of the embodiment of FIG. 2 will now be described assuming that the edge guides 36 and 38 are set for a small sheet width and a larger sheet is to be used in a copying operation.

The apparatus operator pivots the handle 52 and thereby the arm 50 clockwise. The engagement of the edge of the arm 50 with the pin 88 causes the link 84 to pivot counterclockwise which in turn causes the link 74 to move in a direction opposite to the arrow 82 due to the engagement of the pin 94 in the slot 92. This causes the bracket 68 to also move in the direction opposite to the arrow 82 through emgagement of the tab 80 with the pin 70. This movement of the bracket 68 causes the edge guides 36 and 38 to move apart against the force of the spring 72 to guidingly receive the larger sheet (See FIG. 3).

The clockwise movement of the arm 50 causes the gear sector 54 to also rotate clockwise due to the engagement of the pin 58 in the slot 60. The clockwise rotation of the gear sector 54 produces counterclockwise rotation of the gear 30, sprocket 28, chain 26 and sprockets 24. The counterclockwise rotation of the sprockets 24 causes the same to screw further onto the bolts 20 thereby increasing the pressing force between the rollers 12 and 18 as desired. In this manner, the pressing force is increased as a predetermined function of the sheet size. When the handle 52 is rotated counterclockwise, the operations just described occur in reverse to bring the edge guides 36 and 38 closer together and decrease the pressing force between the rollers 12 and 18. Preferably, the springs 22 are selected so as to attain their free lengths when the edge guides 36 and 38 are moved so closely together that they almost touch. This reduces the pressing force between the rollers 12 and 18 to zero to enable the apparatus operator to remove a sheet which may have become jammed therebetween.

A second embodiment of the invention is shown in FIG. 3 in which the handle 52 and arm 50 are replaced by an actuating member comprising a manually rotatable knob 100 which is fixedly mounted on a shaft 102. The sprockets 24 are replaced by worm gears 104 which are threaded on the bolts 20. Worms 106 are mounted on a shaft 108 and mesh with the worm gears 104. A bevel gear 110 is mounted on the shaft 102 and meshes with a bevel gear 112 which is mounted on the shaft 108. Rotation of the knob 100 causes the shaft 102 and bevel gear 110 to rotate therewith. This causes the bevel gear 112 and thereby the shaft 108 and worms 106 to rotate. This in turn causes the worm gears 104 to rotate and move the heads **20*a* of the bolts 20 relative to the movable mounting 14 to vary the pressing force between the rollers 12 and 18. In other words, rotation of the knob 100** varies the pressing force.

A gear 114 is also fixed to the shaft 102 and meshes with a gear 116 integral with a pulley 118. A belt 120 is trained around the pulley 118 and also around idler pulleys 122 and 124. A tab 126 is fixed to the belt 120 in such a manner that the spring 72 urges the pin 70 thereagainst. Rotation of the knob 100 causes rotation of the belt 120 and pulleys 118, 122 and 124 in such a manner that the tab 126 moves laterally as indicated by an arrow 128. Due to the action of the spring 72, the guide plate 38 is urged to move along with the tab 126. Rotation of the knob 100 thereby causes lateral movement of the edge guides 36 and 38 toward and away from each other in the same manner as the handle 52. The various elements of this embodiment are selected so that the pressing force between the rollers 12 and 18 increases as the edge guides 36 and 38 are moved away from each other.

Figure 4:
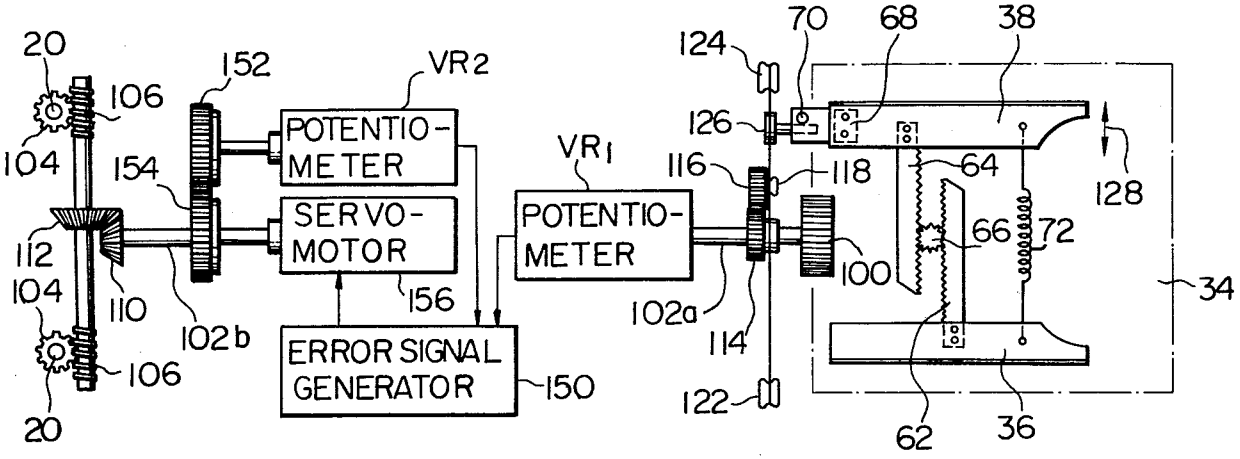
FIG. 4 is a schematic view from below of a third embodiment of the present invention.

A third embodiment of the invention is shown in FIG. 4 which is similar to the embodiment of FIG. 3. The difference is that a servo drive means is provided between the knob 100 and the bevel gear 110. This embodiment mades it very easy to turn the knob 100.

The shaft 102 is replaced by a shaft **102*a* which is connected to the knob 100 and a shaft 102*b* which is connected to the bevel gear 110. A potentiometer VR1 has its slider connected for rotation with the shaft 102*a*. The slider or output voltage of the potentiometer VR1 is applied to an error signal generator 150 in such a manner that the potentiometer VR1 serves as a position signal generator. The output voltage of the potentiometer VR1 is analogous to the required rotational position of the shaft 102*b***.

A potentiometer VR2 has its slider geared for rotation with the shaft **102*b* through gears 152 and 154. The slider or output voltage of the potentiometer VR2 is also applied to the error signal generator 150 in such a manner that the potentiometer VR2 serves as a feedback signal generator indicating the actual or instantaneous position of the shaft 102*b*. The output of the error signal generator 150 is connected to a servo motor 156 which is drivingly connected to the shaft 102*b*. In operation, the error signal generator 150 produces a positive or negative output when the shaft 102*b* is not in the position indicated by the potentiometer VR1 to drive the servo motor 156 in the required direction to make the indicated and actual positions of the shaft 102*b*** coincide.

Figure 5:
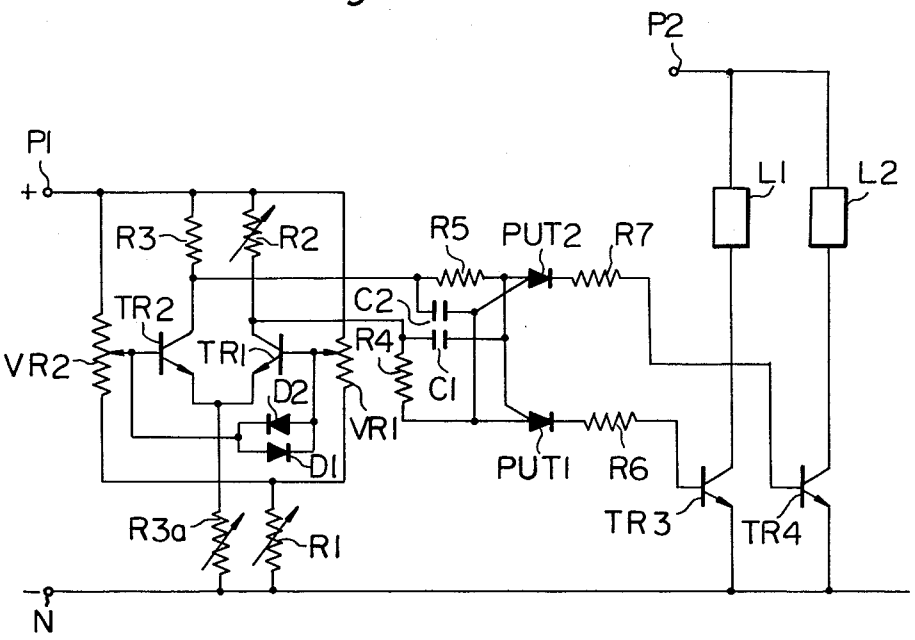
FIG. 5 is an electrical schematic diagram of a servo drive means of the embodiment shown in FIG. 4.

A preferred embodiment of the error signal generator 150 is shown in FIG. 5 in combination with the potentiometers VR1 and VR2.

The potentiometer VR2 connected to the servo motor 156 and the potentiometer VR1 connected to the knob 100 are connected together at their opposite ends through a common variable resistor R1 between a negative d.c. supply terminal N and a positive d.c. supply terminal P1. The potentiometers VR1 and VR2 form a bridge circuit. The sliders of the potentiometers VR1 and VR2 are connected to the bases of NPN transistors TR1 and TR2 respectively, and are connected together through reverse parallel connected diodes D1 and D2. The transistors TR1 and TR2 form a high gain differential amplifier, and their emitters are connected together through a common variable resistor R3*a* to the supply terminal N, while their collectors are connected to the supply terminal P1 through a variable resistor R2 and a fixed resistor R3, respectively.

The output of the high gain differential amplifier thus constructed is applied to a high sensitivity switching circuit including programmable unijunction transistors. Specifically, the collector of the transistor TR1 is connected through a resistor R4 to the anode of a programmable unijunction transistor PUT1. It is also connected through a capacitor C1 to the gate of the programmable unijunction transistor PUT1 as well as to the anode of another programmable unijunction transistor PUT2. The collector of the transistor TR2 is connected through a resistor R5 to the anode of the programmable unijunction transistor PUT2. It is also connected through a capacitor C2 to the gate of the programmable unijunction transistor PUT2 as well as to the anode of the programmable unijunction transistor PUT1. As is well known, the gate voltage of these programmable unijunction transistors can be freely set by variation of an external resistance. The cathode of the unijunction transistors PUT1 and PUT2 are connected to the bases of NPN transistors TR3 and TR4 through resistors R6 and R7, respectively. The transistors TR3 and TR4 have their emitters connected to the supply terminal N and their collectors connected to a positive d.c. supply terminal P2 through drivers L1 and L2 respectively. In this manner, the transistors PUT1, PUT2, TR3 and TR4 form a high sensitivity switching circuit. The drivers L1 and L2 are connected to energize the servo motor 156 in a forward or reverse direction, respectively, and may each comprise a relay, thyristor, triac or the like.

In the circuit described above, the required position of the shaft 102*b* is established by the potentiometer VR1. The voltage outputs of the sliders of the potentiometers VR1 and VR2 are applied to the bases of the transistors TR1 and TR2, respectively, and the difference voltage therebetween is taken between the collectors of the transistors TR1 and TR2. Thus, the voltage output from the potentiometer VR2 which corresponds to the actual angle of rotation of the shaft 102*b* and the voltage output from the potentiometer VR1 which corresponds to the required angle of rotation are amplified and compared by the differential amplifier incorporating the transistors TR1 and TR2. The output signal across the collectors of the transistors TR1 and TR2 will be positive or negative depending on whether the actual angle of rotation of the shaft 102*b* is less or greater than the required angle. This output signal is applied across the anodes and gates of the programmable unijunction transistors PUT1 and PUT2 to cause one of them to conduct depending on the polarity of the output signal, thereby causing a high collector voltage from the transistor TR1 or TR2 to be applied to the base of the transistor TR3 or TR4 through the programmable unijunction transistor PUT1 or PUT2 depending on which conducts. In response, one of the transistors TR3 or TR4 conducts so that the driver L1 or L2 connected to the conductive transistor to TR3 or TR4 is energized to cause rotation of the servo motor 156 in either the forward or reverse direction. The slider of the potentiometer VR2 rotates with the shaft 102*b*, and when the actual angle of rotation of the shaft 102*b* becomes coincident with the required angle of rotation, the bridge circuit including the potentiometers VR1 and VR2 reaches a balanced condition. Thereupon, the output of the differential amplifier incorporating the transitors TR1 and TR2 is zero, turning off both programmable unifunction transistors PUT1 and PUT2 and also the transistors TR3 and TR4 to stop the servo motor 156.

The hysterisis range of the transistors TR3 and TR4 can be adjusted by means of the variable resistor R3*a* which results in a variation in the gain of the high gain differential amplifier as a result of changing the emitter potential of the transistors TR1 and TR2. In this manner, the response of the servo motor 156 can be adjusted. The gain of the differential amplifier can also be varied by means of the variable resistors R1 and R2. Because of the high gain of the differential amplifier incorporating the transistors TR1 and TR2, stable operation is provided over the entire control range or over the full range of the potentiometer VR1 even though the output of the bridge circuit including the potentiometers VR1 and VR2 may be extremely small.

The invention is of course not limited to the specific embodiments shown, and many modifications within the scope of the invention will become possible for those skilled in the art after receiving the teachings of the present disclosure.

What is claimed is:

1. A pressure fixing apparatus for electrophotography comprising first and second pressure fixing rollers, biasing means pressing the rollers together, adjustor means operatively associated with the biasing means to adjust the latter and thereby the biasing force pressing the rollers together, entry means providing entry for sheets to the apparatus and being adjustable to sheets of different widths, and mechanism means operatively connected between the entry means and the adjustor means such that adjustment of the entry means to accommodate sheets of different width causes the mechanism means to adjust the adjustor means to vary the biasing force pressing the rollers together, whereby the biasing force pressing the rollers is a predetermined function of the width of the sheet in the entry means.

2. An apparatus as in claim 1, in which the biasing means comprises a fixed mounting means rotatably supporting the first roller, a movable mounting means rotatably supporting the second roller, and a spring urging the movable mounting means toward the fixing mounting means; said adjustor means being operatively associated with said spring for varying the biasing force of the spring.

3. An apparatus as in claim 2, in which the adjustor means comprises a rotary member, said spring biasing the rotary member in one direction, said spring engaging said movable mounting means to urge the latter in a direction opposite to said one direction toward the fixed mounting means, the rotary member being rotatable to adjust the biasing force of the spring.

4. An apparatus as in claim 1, in which the entry means comprises first and second parallel, laterally movable sheet edge guides.

5. An apparatus as in claim 4, in which the entry means further comprises a linkage means for producing symmetrical lateral movement of the first and second edge guides.

6. An apparatus as in claim 5, in which the linkage means comprises first and second racks extending perpendicularly from the first and second edge guides respectively and a pinion meshing with the first and second racks.

7. An apparatus as in claim 4, in which the mechanism means comprises a manually movable actuating member connected to the first edge guide and operable to adjust the entry means.

8. An apparatus as in claim 7, in which the mechanism means further comprises a first gear operatively connected to the adjustor means to vary the biasing force of the biasing means upon rotation of the first gear, and a second gear rotatably mounted on the actuating member and meshing with the first gear.

9. An apparatus as in claim 8, in which the actuating member is an arm formed with a longitudinal slot, the mechanism means further comprising a pin fixed to the second gear and engaging in the slot in such a manner that pivotal movement of the arm causes rotation of the second gear.

10. An apparatus as in claim 7, wherein the mechanism means comprises linkage means connecting the actuating member to the first edge guide.

11. An apparatus as in claim 10, in which the actuating member is an arm, the linkage means comprising a pivotal link engaging with the arm for pivotal movement thereby and being formed with a longitudinal slot, and a sliding link slidable by the first edge guide and being formed with a pin engaging in the slot of the pivotal link.

12. An apparatus as in claim 10, in which the actuating member comprises a rotary shaft having a knob, the linkage means comprising a first pulley rotatably with the shaft, a second pulley, and a belt trained around the first and second pulleys, whereby rotation of the knob effects rotation of the first and second pulleys to thereby adjust the first edge guide.

13. An apparatus as in claim 4, in which the entry means further comprises sheet width calibrations, said mechanism means comprising a manually rotatable knob rotatable to operate the first and second edge guides in a manner as to move along the sheet calibrations, the mechanism means comprising servo drive means operatively connecting the knob with the adjustor means such that rotation of the knob adjusts the biasing means.

14. An apparatus as in claim 13, in which the servo drive means comprises a position signal generator operatively connected to and operated by the knob, a feedback signal generator operably connected to the biasing means, a drive motor operatively connected to the adjustor means to adjust the latter, and an error signal generator having inputs from the position signal generator and the feedback signal generator and an output connected to the drive motor.

15. An apparatus as in claim 1, in which the entry means is provided with an entry position at which the pressing force of the biasing means is substantially zero.

* * * * *